United States Patent [19]

Hasegawa

[11] Patent Number: 4,460,634

[45] Date of Patent: Jul. 17, 1984

[54] ADHESIVE SHEET AND METHOD FOR MANUFACTURING THE SAME

[76] Inventor: Masaaki Hasegawa, No. 49-20, Higashi Mukojima 2, Sumida-ku, Tokyo, Japan

[21] Appl. No.: 215,696

[22] Filed: Dec. 12, 1980

[30] Foreign Application Priority Data

| | | | |
|---|---|---|---|
| Dec. 29, 1979 | [JP] | Japan | 54-170648 |
| Feb. 27, 1980 | [JP] | Japan | 55-23519 |
| Feb. 29, 1980 | [JP] | Japan | 55-25076 |

[51] Int. Cl.[3] ..... G09F 15/02

[52] U.S. Cl. ..... 428/124; 156/289; 156/344; 427/208.6; 428/195; 428/904.4

[58] Field of Search ..... 428/198, 124, 187, 43, 428/64, 195; 156/291, 292, 289, 344; 427/208.6

[56] References Cited

U.S. PATENT DOCUMENTS

| | | | |
|---|---|---|---|
| 798,313 | 8/1905 | Alexander | 428/198 |
| 1,619,081 | 3/1927 | McLaurin | 156/289 X |
| 2,109,583 | 3/1938 | Bennett | 428/236 X |
| 2,282,177 | 5/1942 | Dike et al. | 428/479 X |
| 2,411,328 | 11/1946 | MacNab | 428/198 X |
| 3,203,823 | 8/1965 | Grimes | 428/198 |
| 3,257,228 | 6/1966 | Reed | 428/40 X |
| 3,312,005 | 4/1967 | McElroy | 428/42 X |
| 3,385,743 | 5/1968 | Backberg | 428/191 |
| 3,464,842 | 9/1969 | Jackstadt | 428/195 |
| 3,554,835 | 1/1971 | Morgan | 428/198 X |
| 3,900,642 | 8/1975 | Michel | 428/124 X |
| 4,204,017 | 5/1980 | Hefele | 428/198 X |
| 4,235,459 | 11/1980 | Callahan | 428/43 X |

FOREIGN PATENT DOCUMENTS 2909276 9/1980 Fed. Rep. of Germany ..... 428/43

OTHER PUBLICATIONS

Page 648, the title page, the Verso of the title page of Webster's Seventh New Collegiate Dictionary, G&C Merriam Company, Publishers, Springfield, Mass.

*Primary Examiner*—Henry F. Epstein
*Attorney, Agent, or Firm*—Darby & Darby

[57] ABSTRACT

An improved adhesive sheet and method of manufacturing it, the sheet comprising a number of adhesive parts and support parts on its rear surface, said adhesive parts and support parts being alternately arranged equidistantly over the whole area of the rear surface. A single adhesive sheet may be folded so that two sheet halves are brought in contact with one another at their rear surface, wherein the adhesive parts of one sheet half are located opposite to the support parts of the other half, while the support parts of the one sheet half are located opposite to the adhesive parts of the other sheet half. Also, two blank sheets, may be used and made to overlap in substantially the same manner. The adhesive sheets require no protective sheet. The sheets are made by coating the rear surface of one sheet half or blank sheet with an adhesive agent, allowing the rear surfaces of both sheet halves or two blank sheets to overlap and then compressing the overlapped sheet halves or blank sheets with the aid of suitable compressing means, thereby effecting transference of the adhesive agent from the support part of the adhesive-coated sheet or sheet-half to the uncoated adhesive basis of the other sheet or sheet-half.

9 Claims, 17 Drawing Figures

ADHESIVE SHEET AND METHOD FOR MANUFACTURING THE SAME

BACKGROUND OF THE INVENTION

1. Field of the Invention

The present invention relates to an adhesive sheet such as a sticker, poster or the like which is intended to be adhesively sticked to a panel, wall and the like and to a method for manufacturing it. More particularly the present invention relates to a preformed adhesive sheet which is having a number of adhesive parts over its rear face and having a predetermined display pattern such as a letter, figure, photo or the like printed or scribed on the front face thereof and to a method for manufacturing the aforesaid adhesive sheet.

2. Description of the Prior Art

Hitherto, a display or advertisement sheet having a certain display pattern such as a letter, figure, photo and the like printed or scribed on the front face thereof to a panel, wall or the like had to be coated with a liquid adhesive agent over its whole rear face with the aid of a brush, pasting roller or the like prior to sticking onto the panel, wall or the like. However, this conventional process for preparing the display or advertisement sheet required various laborious field operations.

In view of the many difficulties encountered with the conventional display or advertisement sheets such as those described above, an improved adhesive sheet has been developed in recent years which has a rear face coated with an adhesive agent over the whole area thereof and also covered with a protective sheet. However, due to the fact, the adhesive part extends over the whole rear face of the adhesive sheet, substantial force is required to remove the used adhesive sheet and, sometimes, it is very difficult to remove it completely. Therefore it is often found that a part of the used adhesive sheet is left behind on the panel, wall or the like, resulting in unpleasant appearance of the same. In case a panel, wall or the like is made of material which can be easily injured or damaged, the removing or peeling operation causes the panel, wall or the like to be injured or damaged.

Furthermore another drawback of the conventional adhesive sheet is that it requires a separate protective sheet for covering said adhesive part which results in increased material costs.

OBJECT OF THE INVENTION

Hence it is the first object of the present invention to provide an adhesive sheet which requires no substantial force when removing it from a panel, wall or the like where it was adhesively mounted and which can be completely removed therefrom without any residue left behind.

It is the second object of the present invention to provide an adhesive sheet which does not require any protective sheet for covering a number of adhesive parts preformed over its rear face and which can be thus manufactured at a reduced cost.

It is the third object of the present invention to provide a method for manufacturing the adhesive sheet inexpensively without any difficulty, by which method the aforesaid two objects can be satisfactorily accomplished.

SUMMARY OF THE INVENTION

The adhesive sheet in accordance with the present invention has a display or advertisement pattern on its front face and is preformed to have a number of adhesive parts on the rear face thereof, said adhesive parts being uniformly arranged over the whole area of the rear face. Owing to the fact that the adhesive sheet has a number of adhesive parts uniformly arranged it is ensured that the adhesive sheet is adhesively attached to a panel, wall or the like without fail and that it is completely removed therefrom without any necessity for heavy substantial force, resulting in no injury or damage to said panel, wall or the like:

A double layered type adhesive sheet in accordance with the present invention comprises two blank sheets which are formed to have a number of adhesive parts and support parts (having an even and smooth surface) uniformly arranged over the whole area of their rear face, said blank sheets being overlapped in such a manner that their rear faces are brought in contact with one another.

Further, a folded type adhesive sheet in accordance with the present invention comprises a single blank sheet which is formed to have a number of adhesive parts and support parts uniformly arranged over the whole area of its rear face, said blank sheet being folded along a folding line in such a manner that the rear faces of the two sheet halves are brought in contact with one another. The above described double layered-type adhesive sheet and folded-type adhesive sheet do not require any protective sheet to cover the adhesive parts.

One proposed method for manufacturing a double layered-type adhesive sheet in accordance with the present invention comprises coating the rear face of one blank sheet with an adhesive agent, allowing two blank sheets to be overlapped in such a manner they are brought in contact one another at their rear faces, only one of said rear faces being coated with an adhesive agent, and compressing the overlapped blank sheets. This proposed method makes it possible to simplify the step of coating the rear face with an adhesive agent.

BRIEF DESCRIPTION OF THE ACCOMPANYING DRAWINGS

Now the present invention will be described in more detail with reference to the accompanying drawings which illustrate preferred embodiments of the present invention. It is to be noted that similar parts or components throughout the drawings are identified by the same reference numerals.

Figure 1:
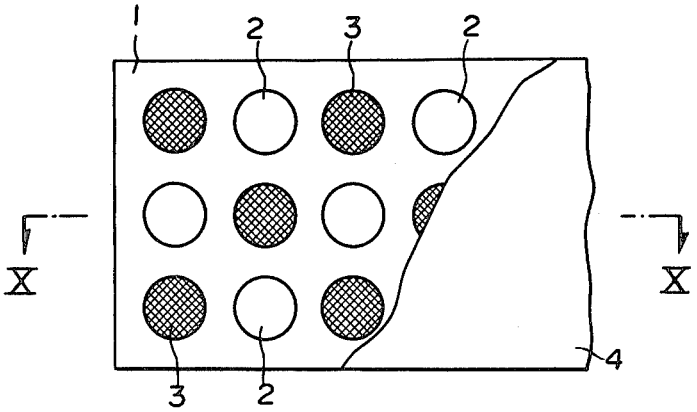
FIG. 1 is a plan view of an adhesive sheet made of paper in accordance with a preferred embodiment of the present invention, wherein the rear face of the adhesive sheet is covered with a protective sheet which is partly shown.
Figure 2:
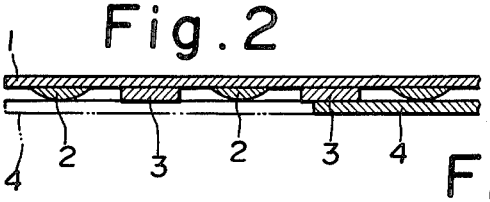
FIG. 2 is a sectional view of the adhesive sheet, taken in line X—X in FIG. 1.

An adhesive sheet 1 in accordance with the first embodiment of the present invention as illustrated in FIGS. 1 and 2 is constructed of commercial printing paper. A required pattern, such as a letter, figure, photo or the like is printed on the front face (not shown) of adhesive sheet 1. Such a pattern may also be scribed on the front face of the adhesive sheet 1 after completion of adhesion of the same onto a panel, wall or the like. The adhesive sheet 1 has a number of adhesive pieces 2 at its rear face. The adhesive pieces 2 are prepared by pasting an adhesive agent in selected areas on the rear face of adhesive sheet 1. Polyvinylether, polyisobutylene, SBR, butyl rubber and others are usually employed as adhesive agents. The adhesive pieces 2 are uniformly located at a constant distance from one another in two cross directions at right angles to one another over the whole rear face of the adhesive sheet 1. As apparent from FIG. 1, each adhesive piece 2 has the same configuration, that is, a small circle in case of the first embodiment. It should be of course understood that the configuration of the adhesive piece is not limited only to a small circle and it may assume other shapes such as a square, strip or the like. As readily seen from FIG. 2, the respective adhesive pieces 2 are in the form of a spherical section, as seen from the side. This allows adhesive sheet 1 to be adhesively mounted on a panel, wall or the like with a reduced contact surface therebetween. As a result adhesive sheet 1 can be peeled off with a considerably reduced force. It is to be noted that adhesive pieces 2 may be of uniform thickness. This will result in an increased contact surface between adhesive sheet 1 and the panel, wall or the like and therefore a tighter adhesive attachment of the former to the latter. Decision as to which type of adhesive piece should be employed will be dependent on the adhesive power of the adhesive pieces, and on the surface condition of the panel, wall or the like.

Furthermore, adhesive sheet 1 has a number of support pieces 3 which are located between the adjacent adhesive pieces 2. Thus adhesive pieces 2 and support pieces 3 are alternately located in an equally spaced relation in two cross directions at right angles to one another. Support pieces 3 have a flat and smooth surface and are constructed by fixedly securing a circular plastic piece to the adhesive sheet 1. Preferably, support pieces 3 have substantially the same thickness as adhesive pieces 2. This is to ensure that support pieces 3 keeping the surface of adhesive sheet 1 even after the same is attached to a panel, wall or the like. In the present drawings the thickness of adhesive sheet 1, adhesive pieces 2 and support pieces 3 is exaggerated for purposes of illustration. Moreover, support pieces 3 have substantially the same configuration as adhesive pieces 3.

Adhesive sheet 1 is covered with a protective sheet 4 at its rear face, said protective sheet 4 having the same shape as that of the adhesive sheet 1. The protective sheet 4 is either a paper sheet having at least one face covered or coated with plastic material or a plastic sheet. Thus protective sheet 4 is adhesively secured to adhesive pieces 2 of adhesive sheet 1 with considerably reduced adhesive force, which permits protective sheet 4 to be pulled off easily when adhesive sheet 1 is to be mounted on a panel, wall or the like.

Adhesive sheet 1 can be adhesively secured to a panel, wall or the like by pressing the former against the latter. Secure adhesive attachment of adhesive sheet 1 to the wall or panel is ensured by the uniform arrangement of adhesive pieces 2 over the whole rear face of adhesive sheet 1. The fact that adhesive sheet 1 has a smaller contact surface than conventional sheets which had their rear face fully coated with an adhesive agent, ensures its easy peel off from the panel, wall or the like leaving only small visible marks thereon without injury or damage.

Figure 3:
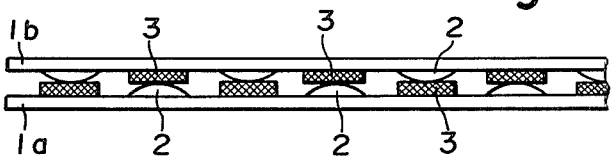
FIG. 3 is a side view of an adhesive sheet in accordance with another preferred embodiment of the present invention, wherein the adhesive sheet is constructed in the form of a double layer.

FIG. 3 illustrates a double-layered-type adhesive sheet in accordance with the present invention. This double-layered-type adhesive sheet comprises two adhesive sheets 1*a* and 1*b* each having the same structure those as illustrated in FIGS. 1 and 2. Sheets 1*a* and 1*b* positioned in such a manner that the rear face of one contacts the rear face of the other. It is to be noted that adhesive pieces 2 of adhesive sheet 1*a* come in adhesive contact with support pieces 3 of adhesive sheet 1*b*, while support pieces 3 of adhesive sheet 1*a* come in adhesive contact with adhesive pieces 2 of adhesive sheet 1*b*. Thus each one of adhesive sheets 1*a* and 1*b* serves to protect the adhesive pieces the other. When adhesive sheets 1*a* and 1*b* are to be attached to a panel, wall or the like, they are parted from each other. Since support pieces 3 of one adhesive sheet are adhered to adhesive pieces 2 of the other sheet with reduced adhesive force, adhesive sheets 1*a* and 1*b* can be easily peeled off one another. It will be readily recognized from the above description that adhesive sheets 1*a* and 1*b* serve as protective sheets one for the other in the same manner as the aforesaid protective sheet 4.

Thus, the double-layered-type adhesive sheet described above does not require a protective sheet to cover its rear face which results in considerable material saving.

It is to be noted that adhesive sheet 1, as illustrated in FIGS. 1 and 2, can be folded along a folding line (not shown) to form two sheet halves in such a manner that their rear faces abut one another. In that case it is essential that adhesive pieces 2 of one sheet half come in adhesive contact with the support pieces 3 of the other sheet half, while adhesive pieces 2 of the other sheet half come in contact with the support pieces 3 of the first sheet half, whereby a folded adhesive sheet (not shown) is obtained. It will be obvious that this folded-type adhesive sheet does not require any protective means such as protective sheet 4. When putting it in use, the sheet halves are unfolded to the original expanded state.

The aforesaid folding line may be in the form of a perforated line. In this case the sheet halves can be torn off from one another along the perforated folding line, when they are unfolded. Thus the respective sheet halves are attached to a panel, wall or the like separately.

Figure 4:
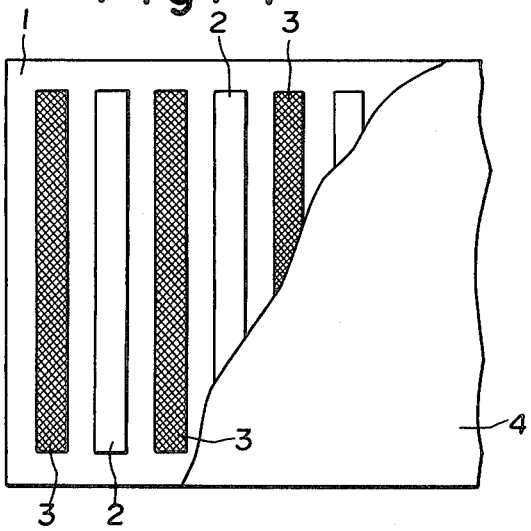
FIG. 4 is a plan view of an adhesive sheet made of paper in accordance with another preferred embodiment of the present invention, wherein the adhesive sheet has a number of adhesive strips attached thereto and is covered with a protective sheet over its rear face, said protective sheet being partly shown.

FIG. 4 illustrates an adhesive sheet made of paper in accordance with the second embodiment of the present invention. In this embodiment, adhesive members 2 and support members 3 are prepared strips, substantially same in form. As apparent from the drawing, adhesive members 2 and support members 3 are extended in parallel at a right angle to the longitudinal direction and are alternately located at an equal distance from each other. This type of adhesive sheet can be adhesively attached to a panel, wall or the like uniformly and tightly in the same manner as the preceding embodiment. The adhesive sheet 1 peels off from the panel, wall or the like without inparting any injury or damage thereto and without leaving a perceptible unpleasant dirty line or trace thereon. Further, adhesive sheet 1 is covered with a protective sheet 4 as illustrated in FIG. 4 to be kept in storage. It is to be added that a double-layered type adhesive sheet or folded-type adhesive sheet can be obtained by combining two blank sheets or folding a single blank sheet in such a manner that the adhesive members of one adhesive sheet or sheet half come in adhesive contact with the support members of the other, as described above.

It should be understood that material of the adhesive sheet is not be limited only to paper as described in the two preceding embodiments and that it may be a plastic material. A few examples of adhesive sheet made of plastic material will be described later. In case of an adhesive sheet made of plastic material, its rear face also serves as the support member. In this type of adhesive sheet the adhesive members are prepared by roughening a predetermined part or parts of the rear face of the adhesive sheet and coating it or them with an adhesive agent.

Figure 5:
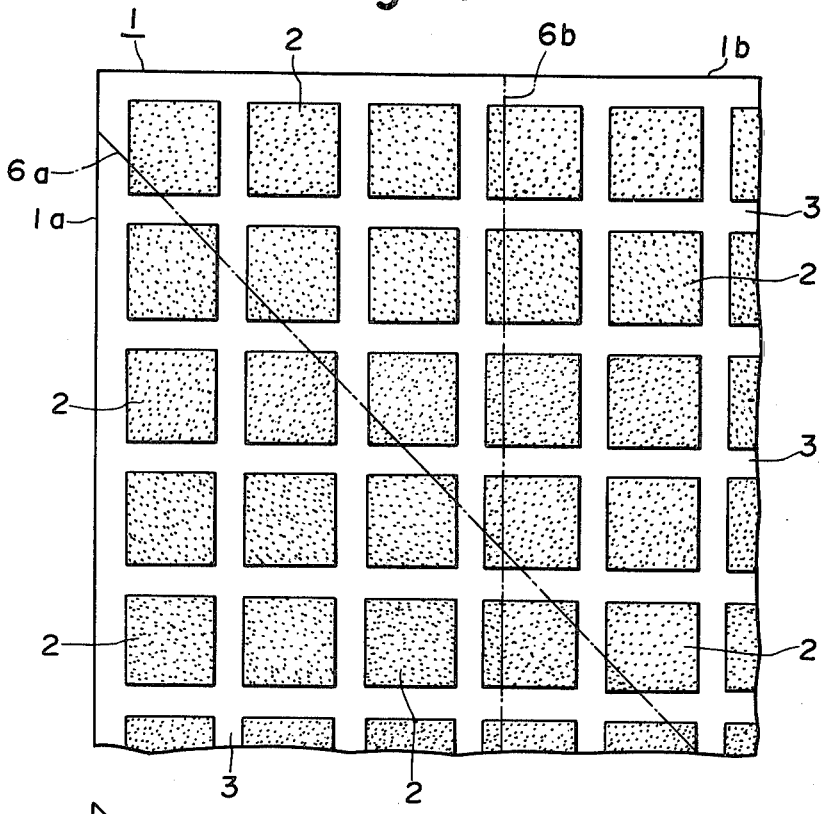
FIG. 5 is a plan view of a single adhesive sheet for a folded-type adhesive sheet made of plastic material in accordance with yet another preferred embodiment of the present invention, wherein the unit adhesive sheet has a number of square adhesive parts preformed over the rear face thereof.
Figure 6:
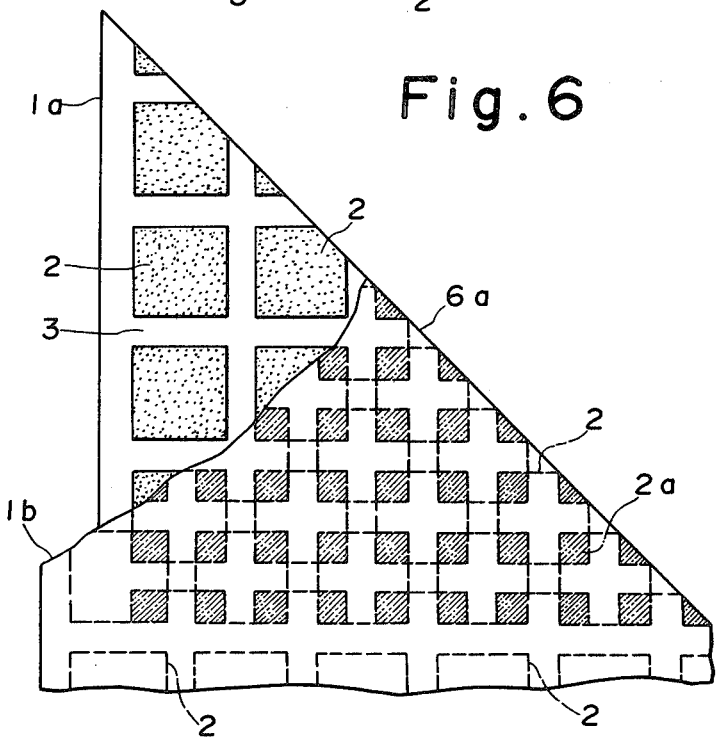
FIG. 6 is a plan view of the folded type adhesive sheet showing the single adhesive sheet of FIG. 5, having both sheet halves folded over one another in an overlapped state.

Next, a folded-type adhesive sheet in accordance with another embodiment of the present invention is illustrated in FIGS. 5 and 6. In this embodiment folding is accomplished by partial overlapping of two opposite sheet halves of an adhesive member. As illustrated in FIG. 5, adhesive sheet 1 is formed with a number of square adhesive parts 2 over its rear face, said adhesive parts 2 being arranged in an equally spaced relation in two cross directions. The free space between any two adjacent adhesive parts 2 has a width shorter than the length of one side of the square adhesive part 2, said width amounting to about one third of the side length of a square adhesive part 2 in this embodiment. Further adhesive sheet 1 has a support part 3 which comprises the free area of the rear face of adhesive sheet 1 excluding adhesive parts 2. Adhesive sheet 1 is adapted to be folded along a folding line 6*a*. Folding line 6*a* extends in parallel to the diagonal line of the base sheet 1 and is spaced from the latter by a substantial distance. Specifically, folding line 6*a* passes through points on the sides of adhesive parts 2 where said sides are divided into three pieces by the diagonal line, said three pieces having one third of the length of the respective sides. When folding the adhesive sheet 1 along the folding line 6*a* so that the respective sheet halves 1*a* and 1*b* are brought in contact with one another at their rear faces, partial adhesive attachment is achieved between the adhesive parts 2 of one sheet half 1*a* and the adhesive parts 2 of the other sheet half 1*b* of the adhesive sheet 1, as illustrated in FIG. 6. In this embodiment the adhesive contact area (defined by the four hatched parts) of the respective adhesive parts 2 amounts to four ninths of the whole area thereof.

Since the rear face of adhesive sheet 1 is covered with the adhesive sheet itself, no separate protective sheet is required. When it is to be in use, the respective sheet halves 1*a* and 1*b* of the folded adhesive sheet 1 are unfolded and expanded by peeling off one from another. Because of the fact that partial adhesive attachment has been established between the opposite adhesive parts 2 only a small force is required for unfolding them.

Alternatively, adhesive sheet 1 may be folded along another folding line 6*b* in FIG. 5. This folding line 6*b* extends across the adhesive parts 2 which are aligned in the vertical direction so that the respective adhesive parts are divided into two parts having an area ratio of 1 to 5. When folding it along the folding line 6*b*, it follows that an adhesive contact area where adhesive parts 2 of the sheet halves are brought in partial adhesive contact with one another amounts to two thirds of the whole area of the respective adhesive parts 2.

The above adhesive contact area between the opposite adhesive parts 2 varies according to the shape and size of the adhesive parts, the width of the free area between adjacent adhesive parts and the location of the folding line. The aforesaid adhesive contact area should be determined according to the intensity of adhesive power of the particular adhesive agent used so that adhesive folding is ensured for the adhesive sheet 1 and so that the two sheet halves peel off easily.

Figure 7:
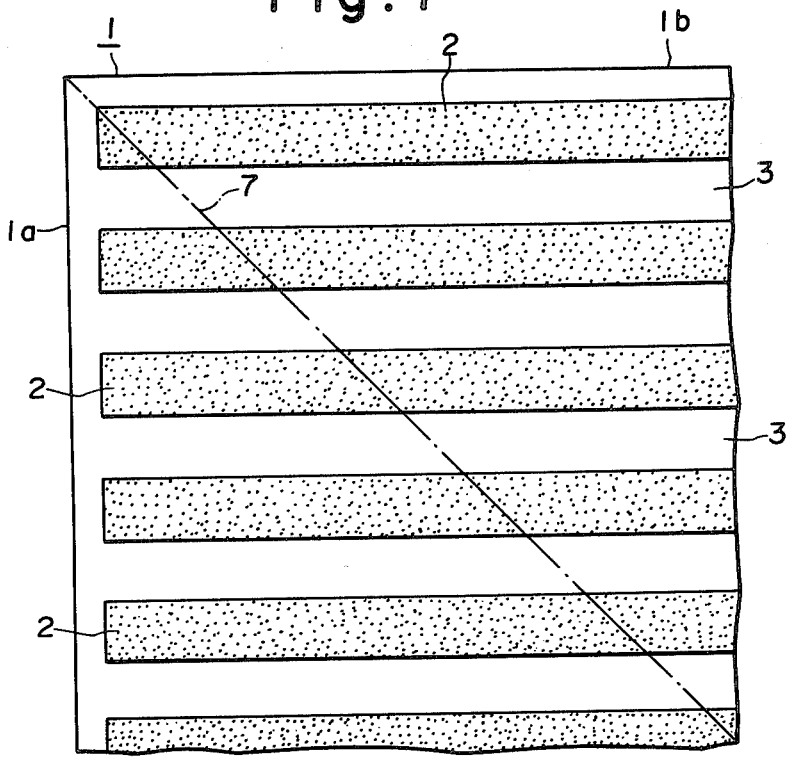
FIG. 7 is a plan view of another single adhesive sheet for a folded-type adhesive sheet made of plastic material in accordance with the present invention, wherein the adhesive sheet has a number of strip-shaped adhesive parts prepared over the rear face thereof.
Figure 8:
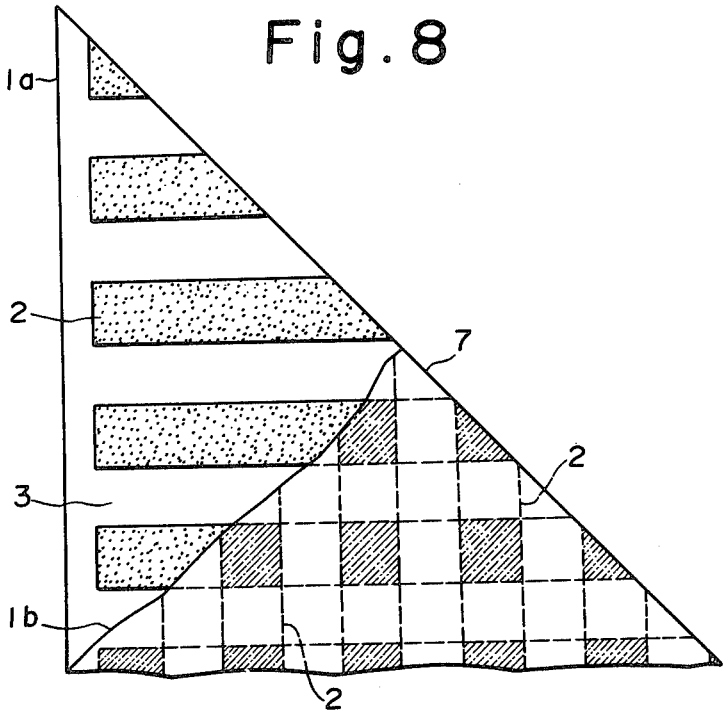
FIG. 8 is a plan view of the folded type adhesive sheet comprising the single sheet of FIG. 7, having both sheet halves folded over one another in an overlapped state.

A folded type adhesive sheet in accordance with still another embodiment of the present invention will be described below with reference to FIGS. 7 and 8. In this embodiment adhesive sheet 1 is formed to have a number of strip-shaped adhesive parts 2 at its rear face, said strip-shaped adhesive parts 2 being arranged in parallel at an equal distance. The free area other than the adhesive parts 2 at the rear face of adhesive sheet 1 serves as the support part 3, said free area having an even surface. In this embodiment, adhesive sheet 1 is folded along folding line 7 which corresponds to the diagonal line of adhesive sheet 1. The opposite strip-shaped adhesive parts 2 at the rear faces of the respective sheet halves 1*a* and 1*b* of adhesive sheet 1 divided by the folding line 7 are adhesively attached to one another at so that they intersect at right angles. The adhesive contact areas assume a square shape defined by the hatched part in FIG. 8 and uniformly distributed in an equally spaced arrangement over the whole folded adhesive sheet.

Folding line 7 may be in the form of a perforated line.

The two embodiments of the present invention illustrated in FIGS. 5 through 8 are concerned with a folded-type adhesive sheet of which folding is ensured by partial adhesive contact between the opposite adhesive portions of the two halves. This technique of partial adhesive contact is applicable to a double-layered-type adhesive sheet which comprises a combination of two adhesive sheets the rear faces of which are brought in adhesive contact with one another, wherein a partial area of the adhesive portions of one adhesive sheet comes in adhesive contact with a partial area of the adhesive portions of the other adhesive sheet.

Figure 9:
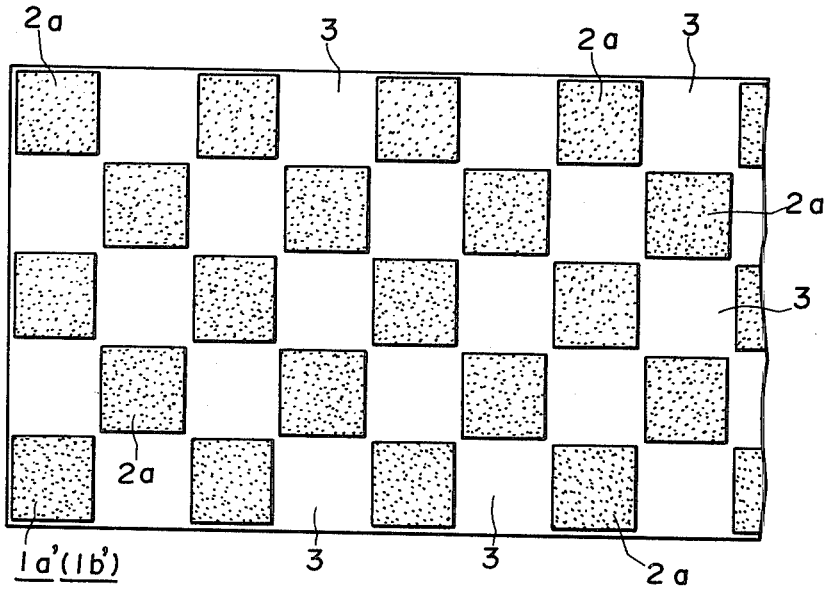
FIG. 9 is a plan view of a blank sheet for manufacturing a double-layered-type adhesive sheet, wherein said blank sheet is formed with a number of square adhesive part bases over the rear face thereof.

Next, a method for manufacturing a double-layered-type adhesive sheet easily and inexpensively will be described below with reference to FIGS. 9 through 14. FIG. 9 illustrates one of blank sheets 1*a*′ and 1*b*′ for manufacturing a double layered type adhesive sheet. Blank sheet 1*a*′ is made of plastic material. Blank sheet 1*a*′ is formed to have a number of adhesive portion bases 2*a* over its rear face. Adhesive bases 2*a* are prepared by roughening predetermined partial areas on the rear face of blank sheet 1*a*′. The free area other than adhesive portion bases 2*a* at rear face of the blank sheet 1*a*′ serves as a support portion and has an even surface. The respective adhesive portion bases 2*a* assume a square shape and are arranged in an equally spaced relation in two cross directions. The distance across the free space between adjacent adhesive portion bases 2*a* is substantially equal to the width thereof or a little wider than the same. This results in support portions 3 formed which have substantially the same shape as adhesive portion bases 2*a*, or a shape a little larger than the latter. The other blank sheet 1*b*′ to be overlapped is prepared in the same manner as described above.

Figure 11:
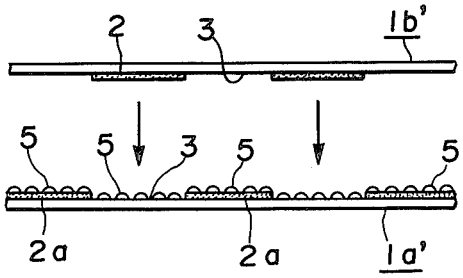
FIG. 11 is a side view of two blank sheets, wherein one of them is coated with an adhesive agent over the whole rear face thereof, while the other one is not so coated.

Then, one of blank sheets 1*a*′ and 1*b*′, for instance, blank sheet 1*a*′ is coated with an adhesive agent designated by the reference numeral 5 over the whole rear face thereof (see FIG. 11). The adhesive agent 5 isn't required to be coated to cover the whole rear surface of the adhesive sheet 1*a*′, but it may be coated in the form of a number of points or parallel strips which are uniformly distributed thereon.

Figure 12:
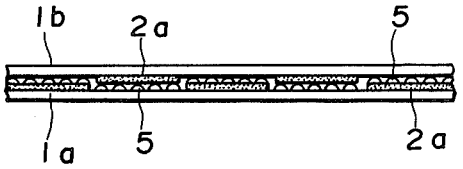
FIG. 12 is a side view of the two blank sheets in FIG. 11, showing said sheets in adhesive contact at their rear face.

After completion of coating, both blank sheets 1*a*′ and 1*b*′ are overlapped in such a manner that their rear faces are brought in adhesive contact as illustrated in FIG. 12, wherein blank sheet 1*b*′ is coated with no adhesive agent. It is essential that overlapping is effected such that adhesive portion bases 2*a* of one blank sheet 1*a*′ are located opposite to the support portions 3 of the other blank sheet 1*b*′, while support portions 3 of blank sheet 1*a*′ are located opposite to adhesive portion bases 2*a* of blank sheet 1*b*′.

Figure 13:
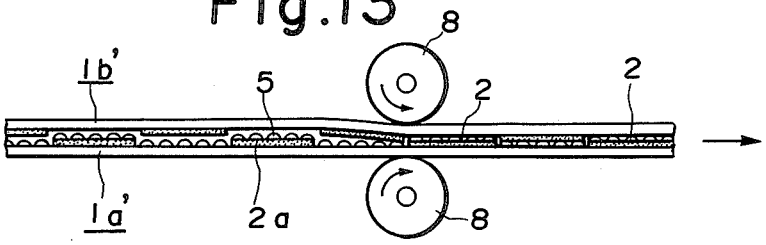
FIG. 13 is a side view of the overlapped blank sheets in FIG. 12, said overlapped blank sheets being subjected to compression.

Then overlapped blank sheets 1*a*′ and 1*b*′ are subjected to compression with the aid of compression means such as a pair of rollers as illustrated in FIG. 13. Compression causes adhesive agent 5 on the adhesive portion bases 2*a* of blank sheet 1*a*′ to be tightly adhered to the adhesive portion bases 2*a*, whereby the required adhesive portions 2 are formed on blank sheet 1*a*′. Meanwhile, compression causes adhesive agent 5 on the support portions 3 of blank sheet 1*a*′ to be transferred to the adhesive portion bases 2*a* of the other blank sheet 1*b*′ and become tightly adhered thereto, whereby the required adhesive portions 2 are formed on the other blank sheet 1*b*′. The above described transference of the adhesive agent is attributable to the fact that the adhesive portion bases 2*a* have higher affinity for the adhesive agent 5 than support portions 3. Now a double layered tupe adhesive sheet is provided which comprises the overlapped adhesive sheets 1*a* and 1*b* both of which are formed with a number of adhesive portion bases 2*a* and support parts 3.

Figure 14:
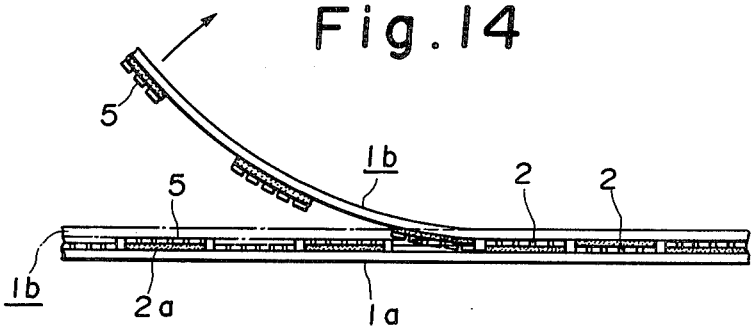
FIG. 14 is a side view of the double layered type adhesive sheet of FIG. 13, wherein the respective blank sheets are peeled away one from another.

When the adhesive sheets 1*a* and 1*b* are to be adhesively attached to a panel, wall or the like, they are peeled off from one another as illustrated in FIG. 14.

Figure 10:
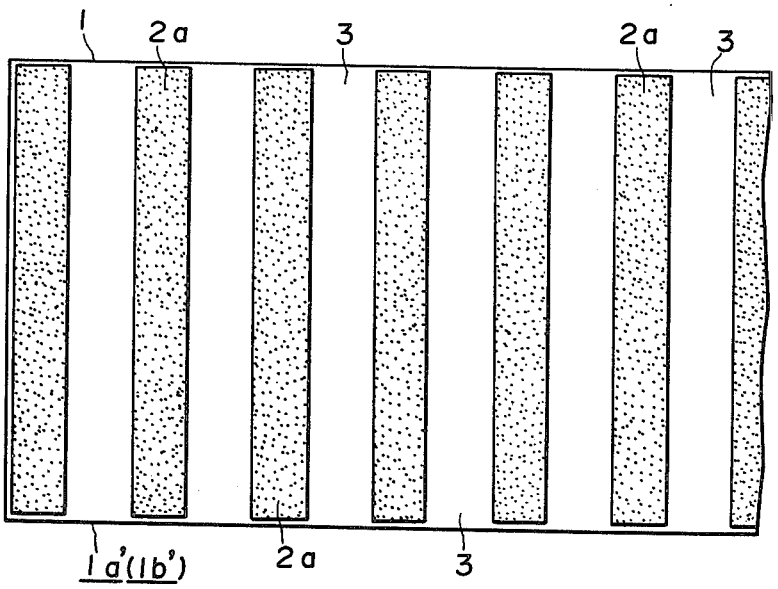
FIG. 10 is a plan view of a modified blank sheet for a double-layered-type adhesive sheet, wherein said blank sheet is formed with a number of strip-shaped adhesive part bases over the rear face thereof.

FIG. 10 illustrates a modified embodiment of a blank sheet for manufacturing a double layered type adhesive sheet. The blank sheet 1*a*′ (1*b*′) is formed with a number of strip-shaped adhesive bases 2*a* over the rear surface. Adhesive bases 2*a* are arranged equidistantly in the longitudinal direction. The distance across the free space between adjacent adhesive bases 2*a* (that is, the width of the support parts 3) is substantially equal to the width of adhesive bases 2*a* or a little wider. It will be obvious that a method for manufacturing a double-layered-type adhesive sheet with the use of the above blank sheet 1*a*′ (1*b*′) is substantially the same as the above-described method.

Figure 15:
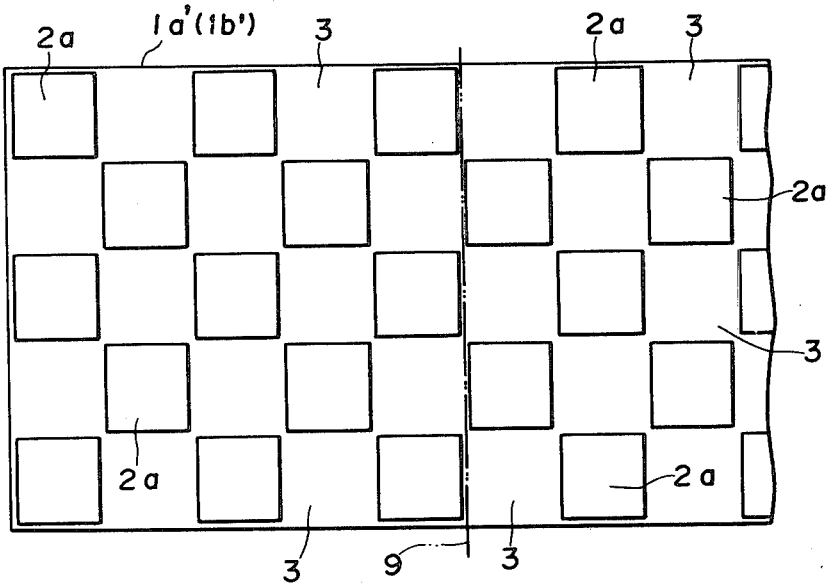
FIG. 15 is a plan view of another blank sheet for a double-layered-type adhesive sheet.
Figure 16:
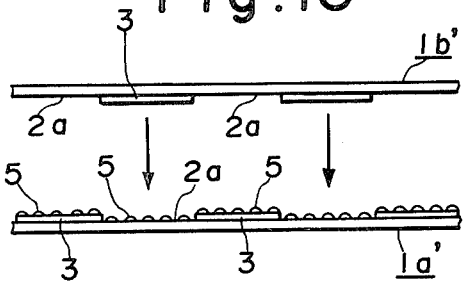
FIG. 16 is a side view of two blank sheets similar to those of FIG. 11, wherein one of them is coated with an adhesive agent over the whole rear face thereof, while the other one is not so coated.
Figure 17:
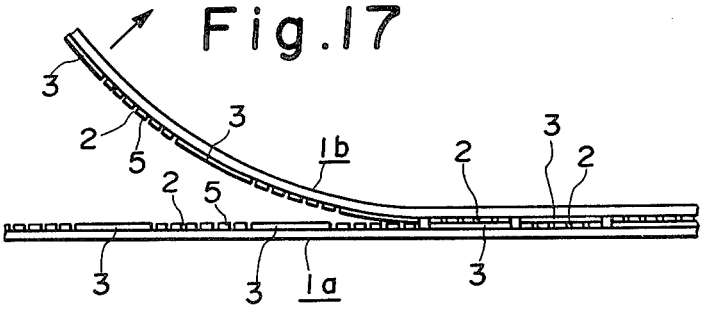
FIG. 17 is a side view of the double layered type adhesive sheet similar to FIG. 14, wherein the respective blank sheets are peeled away from one another.

The above two embodiments concern blank sheets made of plastic material, but such sheets may be made of paper as described below. As illustrated in FIG. 15, a blank sheet 1*a*′ (1*b*′) made of paper has an even support portion 3 on which a plastic material is adhesively placed, said support portion 3 extending over the rear surface of said blank sheet 1*a*′ (1*b*′) excluding square adhesive bases 2*a*. Adhesive bases 2*a* receive no surface treatment. First, one blank sheet 1*a*′ is uniformly coated with adhesive agent 5 over the whole area of the rear surface thereof (see FIG. 16). Then both blank sheets 1*a*′ and 1*b*′ are overlapped such that they are brought in contact one another at their rear surface, wherein one blank sheet 1*a*′ is coated with adhesive agent 5, while the other blank sheet 1*b*′ is not so coated. It is to be noted that overlapping is effected in such a manner that the adhesive bases 2*a* of one blank sheet are located opposite to the support parts 3 of other blank sheet. Thereafter the overlapped blank sheets are compressed with the aid of suitable compressing means. Compression allows adhesive agent 5 on adhesive bases 2*a* of blank sheet 1*a*′ to be tightly adhered thereto, whereby the required adhesive parts 2 are formed. Meanwhile, adhesive agent 5 on the support parts 3 of blank sheet 1*a*′ is transferred to adhesive bases 2*a* of the other blank sheet 1*b*′ and is tightly adhered thereto. This causes the required adhesive bases 2 to be formed on the other blank sheet 1*b*′. FIG. 17 illustrates how the overlapped adhesive sheets 1*a* and 1*b* are parted away by peeling off. It will be clearly understood that adhesive portions 2 and support portions 3 are prepared over the respective adhesive sheets. In this embodiment adhesive portions 2 and support portions 3 on the respective adhesive sheets 1*a* and 1*b* have the substantially same thickness by controlling the quantity of adhesive agent to be coated.

The above described method for manufacturing a double layered type adhesive sheet can be employed for manufacturing a folded type adhesive sheet comprising a single adhesive sheet. Specifically, a blank sheet 1*a* is adapted to be folded along a folding line 9 so that two sheet halves are provided. For instance, left sheet half is uniformly coated with adhesive agent over the whole rear face thereof. Then folding is effected along the folding line in such a manner that both sheet halves are brought in contact at their rear surface, wherein adhesive bases 2*a* of the left sheet half are located opposite to the support portions 3 of the right sheet half, while the support portions 3 of the left sheet half are located opposite adhesive part bases 2*a* of the right sheet half. After completion of the folding operation, the overlapped adhesive sheets are subjected to compression in quite the same manner as the preceding embodiments, whereby a number of adhesive portions 2 are prepared over the whole rear faces of the overlapped sheets. Obviously, the aforesaid folding line may be replaced by a perforated line.

What is claimed is:

1. A display poster comprising a pressure-sensitive adhesive sheet capable of removably adhering to a substrate without damaging said substrate, said composite sheet comprising:

(a) a single base sheet having first and second surfaces;

(b) a plurality of distinct strips of pressure-sensitive adhesive material affixed on said first sheet surface and bearing a pressure-sensitive adhesive for adhesively but removably affixing said sheet onto said substrates, said adhesive strips lying substantially on the same plane, said plane being elevated with respect to said sheet surface;

(c) a plurality of distinct non-adhesive strips also affixed on said first sheet surface, said non-adhesive strips also lying on substantially the same plane, said plane also being elevated with respect to said first sheet surface and substantially of the same elevation as the plane of said adhesive strips, said non-adhesive strips supporting said base sheet so as to lie even on said substrate; said adhesive and non-adhesive strips being alternately disposed in an equally spaced relation on said first sheet surface, thereby leaving a substantial portion of said first sheet surface free; and (d) indicia consisting of the display of said poster disposed on said second sheet surface; wherein said substrate is different from said second sheet surface.

2. A composite adhesive sheet as described in claim 1 wherein said adhesive and non-adhesive strips are raised off the plane of said first sheet surface.

3. A composite adhesive sheet as described in claim 2 wherein said adhesive and non-adhesive strips have substantially the same configuration.

4. A composite adhesive sheet as described in claim 3 wherein said adhesive and non-adhesive strips are arranged in columns and rows.

5. A composite adhesive sheet as described in claim 4 wherein said non-adhesive strips are made of plastic.

6. A composite adhesive sheet as described in claim 4 wherein said adhesive and non-adhesive strips are arranged to extend substantially across the full surface area of said first surface of said base sheet.

7. A composite adhesive sheet as described in claim 4 wherein said sheet further comprises a fold line at a predetermined position whereby said sheet can be folded and a predetermined number of said non-adhesive zones and said adhesive zones can thereby be disposed opposite each other in a predetermined arrangement.

8. A composite adhesive sheet as described in claim 7 wherein said opposed adhesive zones and non-adhesive are brought into contact with each other.

9. A composite adhesive sheet assembly comprising a first composite sheet according to claim 4 disposed opposite a second composite sheet according to claim 4 whereby said first surface of said first sheet is opposed to said first surface of said second sheet and said adhesive zones of said first sheet abut said non-adhesive zones of said second sheet and said non-adhesive zones of said first sheet abut said adhesive zones of said second sheet, said sheets removably adhering to each other.

* * * * *